US005678798A

United States Patent [19]

Little

[11] Patent Number: 5,678,798

[45] Date of Patent: Oct. 21, 1997

[54] SWING AWAY SUPPORT BRACKET

[76] Inventor: Roy M. Little, 1439 E. Larkspur La., Camano Island, Wash. 98292

[21] Appl. No.: 656,703

[22] Filed: Jun. 3, 1996

Related U.S. Application Data

[63] Continuation of Ser. No. 280,173, Jul. 25, 1994, abandoned, which is a continuation of Ser. No. 963,563, Oct. 19, 1992, abandoned.

[51] Int. Cl.[6] ..... A47C 7/54

[52] U.S. Cl. ..... 248/289.11; 16/324; 16/333; 16/349; 297/464; 297/DIG. 4; 403/92; 403/322

[58] Field of Search ..... 248/118.1, 118.3, 248/118.5, 289.11, 118; 403/92, 95, 96, 98, 101, 325, 93, 322; 411/347, 384, 354; 16/321, 324, 325, 327, 333, 349; 5/621, 622, 628; 297/411.31, 464, 486, DIG. 4

[56] References Cited

U.S. PATENT DOCUMENTS

| | | | |
|---|---|---|---|
| 398,893 | 3/1889 | Gould | 248/118 X |
| 473,919 | 5/1892 | Edsall | 403/93 X |
| 527,056 | 10/1894 | Gilson | 297/464 |
| 1,527,754 | 2/1925 | Simon | 297/411 X |
| 1,595,557 | 8/1926 | Mamiya | 403/92 X |
| 2,854,852 | 10/1958 | Clark | 403/325 X |
| 3,640,571 | 2/1972 | Keropian | 297/DIG. 4 X |
| 3,704,910 | 12/1972 | Willcott | 297/DIG. 4 X |
| 3,761,126 | 9/1973 | Mulholland | 297/411 X |
| 4,054,319 | 10/1977 | Fogg, Jr. et al. | 297/DIG. 4 X |
| 4,065,179 | 12/1977 | Takasaki | 297/DIG. 4 X |
| 4,073,537 | 2/1978 | Hammersburg | 297/DIG. 4 X |
| 4,632,595 | 12/1986 | Schaeff | 403/92 X |
| 4,732,423 | 3/1988 | Condon | 297/DIG. 4 X |
| 4,828,323 | 5/1989 | Brodersen et al. | 248/118 X |
| 4,846,527 | 7/1989 | Julien et al. | 297/DIG. 4 X |

FOREIGN PATENT DOCUMENTS

| | | | |
|---|---|---|---|
| 186203 | 7/1986 | European Pat. Off. | 297/284 |
| 2740268 | 9/1977 | Germany | 297/284 |
| 1399285 | 7/1975 | United Kingdom | 297/284 |

*Primary Examiner*—Rinaldi I. Rada
*Assistant Examiner*—Clark F. Dexter
*Attorney, Agent, or Firm*—Richardson & Folise

[57] ABSTRACT

A swing support bracket assembly for mounting support pads to wheelchairs. The assembly includes a housing, an axle mounted for rotation in the housing, a toggle pivotally mounted in the housing and having a tapered protrusion adapted to engage a cooperating tapered recess in the axle. The support pad may be mounted either directly or by a number of adjustable clamps and support rods to the housing. In another embodiment it is mounted by such rods and clamps to the axle.

11 Claims, 4 Drawing Sheets

34
50
3
70
62
38
26
86
80
24
32
20
40
30
28
72
10
3

SWING AWAY SUPPORT BRACKET

CROSS-REFERENCE TO RELATED APPLICATION

This application is a continuation of application Ser. No. 08/280,173, filed Jul. 25, 1994, now abandoned, which is application is a continuation of U.S. application Ser. No. 07/963,563 filed Oct. 19, 1992, now abandoned.

BACKGROUND OF THE INVENTION

This invention generally relates to health care equipment and more particularly to a swing away bracket assembly for mounting support pads to wheelchairs.

It is known that physical deformities in persons with neuromuscular disorders are caused by abnormal strength or weakness in particular muscle groups. It is also known that such deformities are usually not controllable by the person afflicted. Further, abnormal reflex responses may cause the deformities to become more pronounced if they are left uncontrolled. One method of controlling such deformities is to use one or more physical supports to position the person in a posture as normal as possible under the circumstances. The use of such supports may not only prevent an increase in the deformities but may actually reduce them over a period of time. Such reduction may result in more normal functioning of the body's internal organs and permit more normal daily living activities.

Use of support pads as therapeutic accessories on wheelchairs is well known, but the pads and mounting apparatus found in the prior art have a number of deficiencies. Most of them are adjustable to varying degrees but once adjusted are designed to remain fixed in the support or "therapeutic" position. Accordingly, when assisting a disabled person into and out of a wheelchair the attendant caregiver must deal with support pads that may to some degree obstruct entry and exit from the wheelchair. The task is complicated by the fact that the disabled person often has little or no control over his or her muscular movements. On the other hand, if the pads are loosened and moved out of the way, then time must be spent to reposition them in the desired therapeutic position.

Another problem encountered with many of the prior art devices is that the attaching and adjusting apparatuses have a certain inherent amount of "play" or "looseness". Consequently, when they are oscillated they tend to rattle. In addition to having physical disabilities, persons with neuromuscular disorders often have accompanying mental disabilities which result in certain types of abnormal behavior. For example, a sound or rattle emitting from a support device can stimulate a muscular response which produces the noise. Finally another deficiency in many of the prior art devices is that they have many sharp edges, corners and protrusions. These undesirable features have the potential to injure the patient who may experience uncontrolled muscular movement.

Accordingly it is an object of this invention to provide a swing away support bracket assembly adapted for use with support pads that will provide both lateral/medial and angular adjustment for precise therapeutic positioning.

It is a further object of this invention to provide for such a device that will permit a support pad to be securely affixed in a therapeutic position but easily moved away from that position for unobstructed entry and exit from a wheelchair.

It is a further object of this invention to provide for such a device which exhibits a minimal amount of looseness or rattle when the support pad is oscillated.

Finally, it is yet another object of this invention to provide for such a device in which the external surfaces of the components are smoothly contoured so as to minimize the potential of impact injury to the patient.

SUMMARY OF THE INVENTION

This invention can be broadly summarized as providing for a swing away support bracket for a support pad which will permit the pad to be securely fixed in a therapeutic position but easily movable away from that position for unobstructed entry and exit from a wheelchair or the like. The bracket includes a housing, an axle mounted for rotation in the housing and a toggle pivotally mounted on the housing for releasably locking the housing with respect to the axle. Particularly, the axle has a recess machined in its cylindrical surface intermediate its ends and the toggle has a protrusion adapted to releasably engage the axle.

In accordance with a more detailed aspect of the invention, the axle recess has opposing tapered walls and the toggle protrusion is correspondingly tapered in cross section providing a wedging engagement between the two. Further, the bracket includes a spring for urging the toggle into engagement with the axle.

One embodiment of the invention includes a support pad connected to the housing. It also includes an axle support bracket mounted for limited rotation on the axle and an end cap mounted within a bore in at least one end of the axle for locking the axle with respect to the support bracket.

Another embodiment of the invention includes a support pad connected to the axle. According to a more detailed aspect of that embodiment the support pad is adjustably connected to the axle with a support rod and a clamp.

DETAILED DESCRIPTION OF THE PREFERRED EMBODIMENTS

The novel features believed to be characteristic of this invention are set forth in the appended claims. The invention itself however may be best understood and its various objects and advantages best appreciated by reference to the detailed description below in connection with the accompanying drawings.

Figure 1:
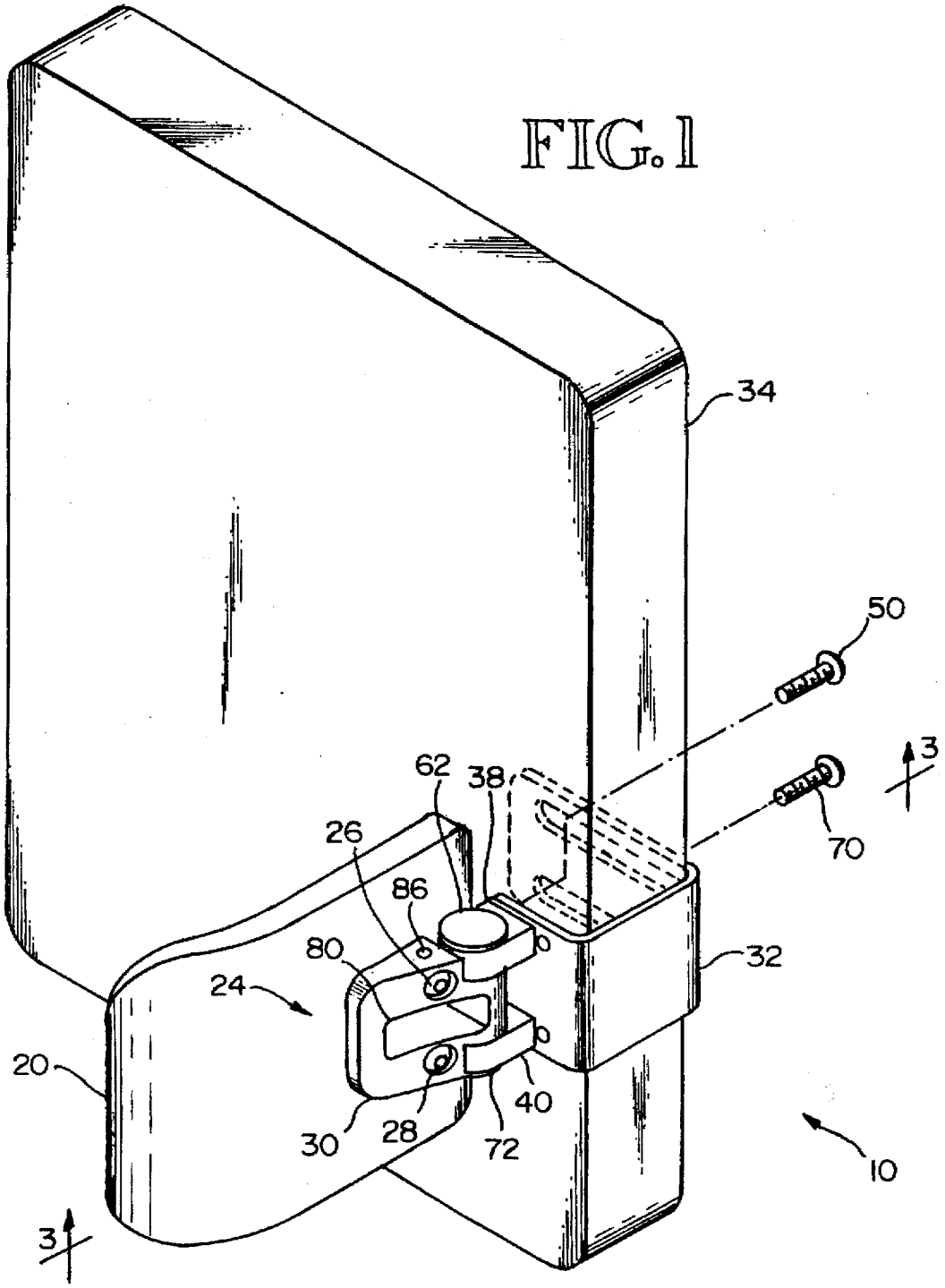
FIG. 1 is a perspective view of one embodiment of the invention illustrating its use with a curved support pad.
Figure 2:
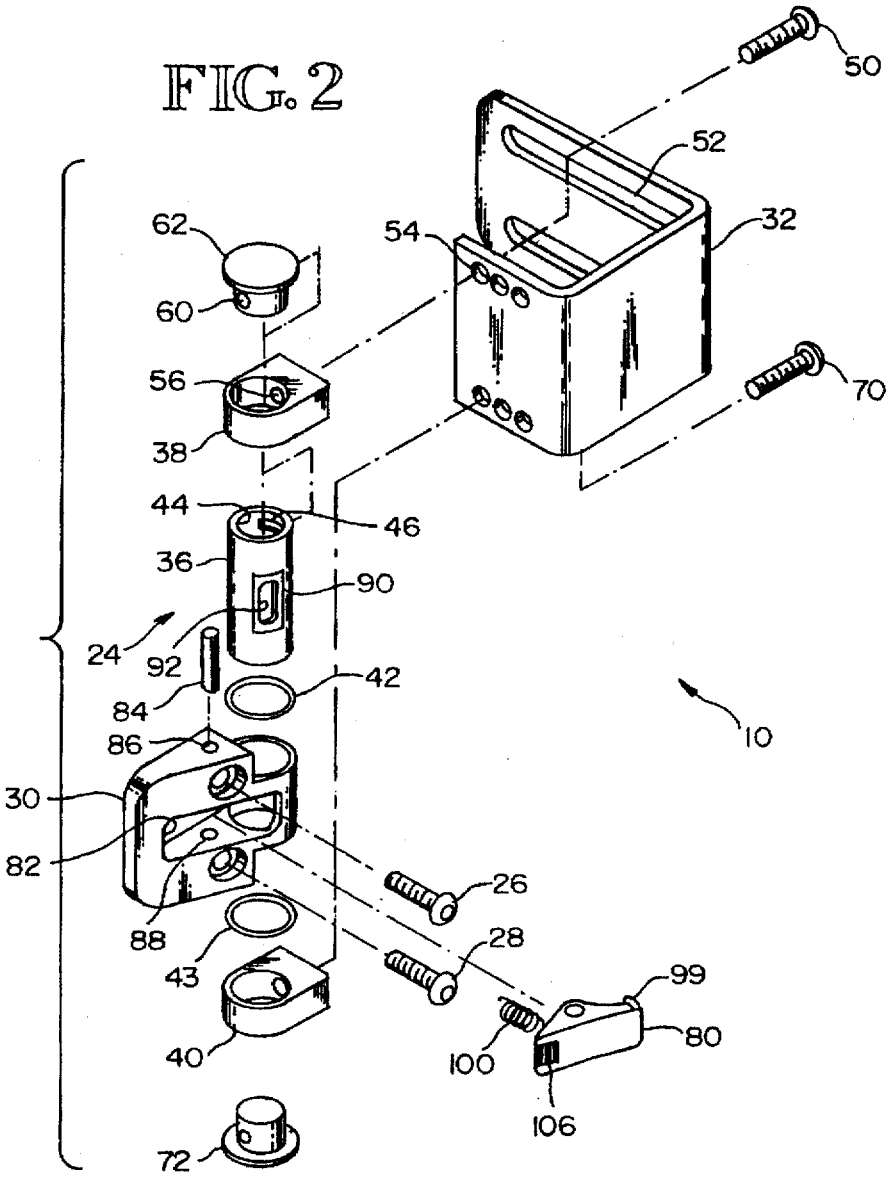
FIG. 2 is an exploded perspective view of the embodiment of FIG. 1.
Figure 3:
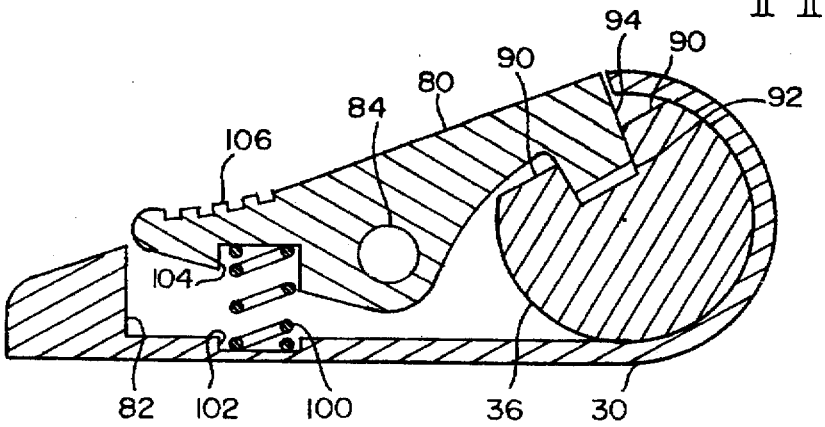
FIG. 3 is a cross sectional view taken at 3—3 of FIG. 1.

In FIGS. 1–3 of those drawings a swing away support bracket assembly constructed in accordance with the teachings of the present invention is illustrated and generally designated by the number 10. In this particular embodiment the invention functions as a trunk support for a wheelchair patient. The assembly includes curved support pad 20 which is mounted to bracket assembly 24 by screws 26 and 28. Such pads are well known in the art, so the details of their construction will not be further described herein. Assembly 24 in turn is fastened to slotted mounting bracket 32 which secures the assembly to rigid back support 34 of the wheelchair (not shown). Although only a left hand assembly is illustrated, it should be understood that it is normally used with an opposing right hand assembly to provide a complete trunk support system.

FIG. 2 shows swing away bracket assembly 24 in greater detail. The assembly includes housing 30 which is mounted for rotation on cylindrical axle 36. The axle is mounted for rotation in upper and lower axle support brackets 38 and 40 respectively. Washers 42 and 43 are positioned over the axle between the housing and the support brackets as shown. Bore 44 is formed in the upper end of the axle and slot 46 is machined through the axle wall formed thereby. Upper axle support bracket 38 is fastened to bracket 32 by bolt 50 which passes through hole 54 and bore 56 in the axle support bracket. Finally, it is threaded into threaded bore 60 in end cap 62 which is seated in bore 44 of the axle. There is a similar bore (not shown) formed in the lower end of the axle and lower axle support bracket 40 is similarly secured to the bracket 32 by bolt 70 and lower end cap 72. Toggle 80 is pivotally mounted within opening 82 in the housing on pin 84 which is inserted in bores 86 and 88.

FIG. 3 shows a detailed cross sectional view of housing 30, axle 36 and toggle 80 in the vicinity of opening 82. In that view it can be seen that flat 90 and tapered recess 92 are machined in the axle. It can also be seen that the right hand end of toggle 80 includes tapered protrusion 94 which is adapted to snugly engage in tapered recess 92. When engaged, this protrusion will prevent relative rotation in either sense (or direction) of the housing with respect to the axle. Preferably the degree of taper of the adjoining surfaces of the protrusion and the recess are identical. Also the degree of taper must be small enough that force applied to support pad 20 will not cause the protrusion to disengage the recess. The protrusion is urged into wedging engagement with the recess by spring 100 which is seated in recesses 102 and 104 in the housing and the toggle, respectively. Finger pressure against ridged surface 106 of the toggle tends to rotate the toggle in a counterclockwise direction, compressing spring 100 and disengaging protrusion 94 from the slot 92.

In order to adjust the support pad to the proper therapeutic position for a particular patient, bolts 50 and 70 are first lightly tightened so that axle 36 is still rotatable with respect to upper and lower axle support brackets 38 and 40. Then, bracket 32 is mounted in an appropriate position on back support 34. Next toggle 80 is depressed sufficiently to remove tapered protrusion 94 from tapered slot 92, permitting housing 30 together with attached pad 20 to be rotated in a counterclockwise position (as viewed from above in FIG. 1) into a convenient, out of the way position so as to facilitate seating of the patient in the wheelchair. After the patient has been seated, the pad is rotated in the opposite direction until protrusion 94 reengages in slot 92. When the toggle is so engaged the pad and housing are locked to the axle and can not be rotated independently of the axle.

In order to make the final adjustment of the pad it is rotated together with the housing and axle into a position of contact with the patient. The extent to which the pad can be rotated for adjustment is determined by the arc length of slot 46 and the corresponding lower slot (not shown) in the wall of the axle. When the proper therapeutic position is reached, assembly 24 is removed from the back support and locked in that position by tightening bolts 50 and 70 so as to lock the axle with respect to the upper and lower axle support brackets. Alternatively, if there is sufficient space between the back support and bracket 32, the bolts can be tightened by inserting an Allen wrench behind the forward leg of bracket 32.

A significant aspect of this invention is that when toggle 80 is in engagement with recess 92 in the axle there is no mechanical "play" or rotation between housing 30 and the axle. Such play is eliminated by the wedging engagement of tapered protrusion 94 in tapered recess 92 as shown in FIG. 3. Accordingly when the swing away bracket assembly is locked in a therapeutic position, rotational movement of the pad with respect to back support 34 is limited to that permitted by the elasticity of the various elements involved. Thus, oscillating pressure on the pad may produce some small movement of it, but will not result in a rattle or play which can be heard or felt by the patient. As discussed in the background section above, the elimination of such a rattle will eliminate undesired responses or involuntary reactions by the patient.

A significant advantage of the invention is that once it is so adjusted, the pad can be quickly moved into a convenient entry/exit position by simply depressing the toggle and rotating the pad as desired. Moreover, it can be quickly and precisely returned to the therapeutic position when desired.

Figure 4:
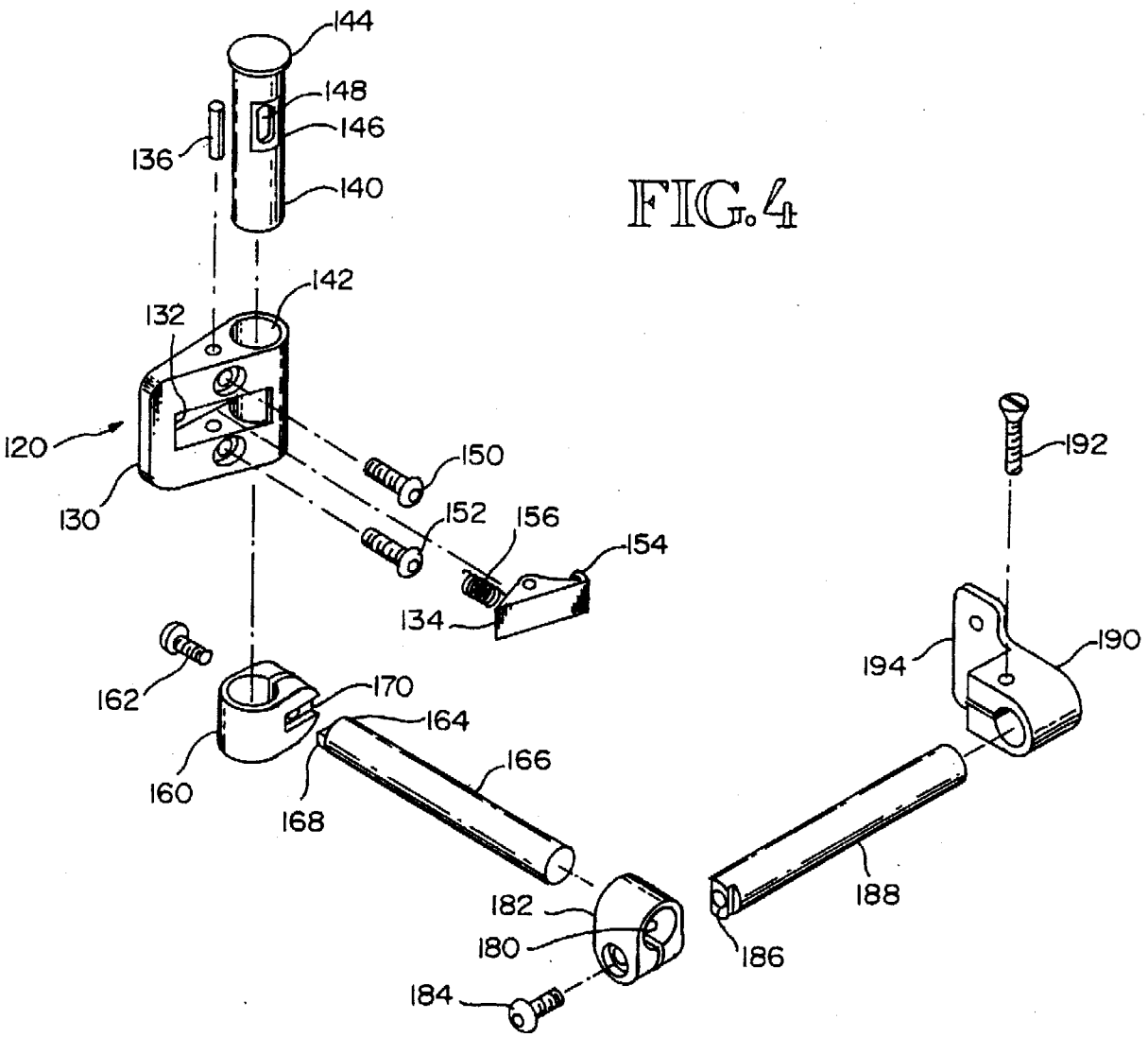
FIG. 4 is an exploded perspective view of a second embodiment of the present invention.

FIG. 4 illustrates a second embodiment of the present invention generally designated by the number 120, in which the housing is secured to the back support or other structural member of the wheelchair and the support pad is attached to one or more adjustable rods and clamps to the axle. Referring to that figure, it can be seen that housing 130 includes recess 132 in which toggle 134 is pivotally mounted on pin 136. Axle 140 is mounted for rotation in bore 142 in the housing and retained in the bore by head 144 formed at its upper end. Also formed in the axle are flat 146 and tapered recess 148 which are identical to flat 90 and recess 92 of axle 36. The housing is fastened to a back support or other structural component (not shown) of the wheelchair by screws 150 and 152. Tapered protrusion 154 from the toggle, which corresponds to protrusion 94 of the first embodiment, is biased into wedging engagement with recess 148 by spring 156.

The axle is retained in bore 142 at its lower end by end fitting 160 which is held into clamping engagement with the axle by the tightening of screw 162 into end 164 of support rod 166. Note that the rod is restricted from rotating with respect to the end fitting by protrusion 168 which slidably engages slot 170. The opposite end of the rod is adjustably inserted in bore 180 of clamp 182 which is identical to clamp 160. The clamp is closed by screw 184 which threadably engages end 186 of support rod 188. Similarly the end of that rod is held in termination fitting 190 which may be closed by tightening the screw 192. A support pad (not shown) similar to support pad 20 can be mounted to bracket 194. It should be apparent to those of ordinary skill by utilizing various combinations of such rods and clamps and various mounting positions of the housing on the wheelchair structure, a support pad can be placed in a wide variety of positions and the utility of this invention substantially expanded.

Figure 5:
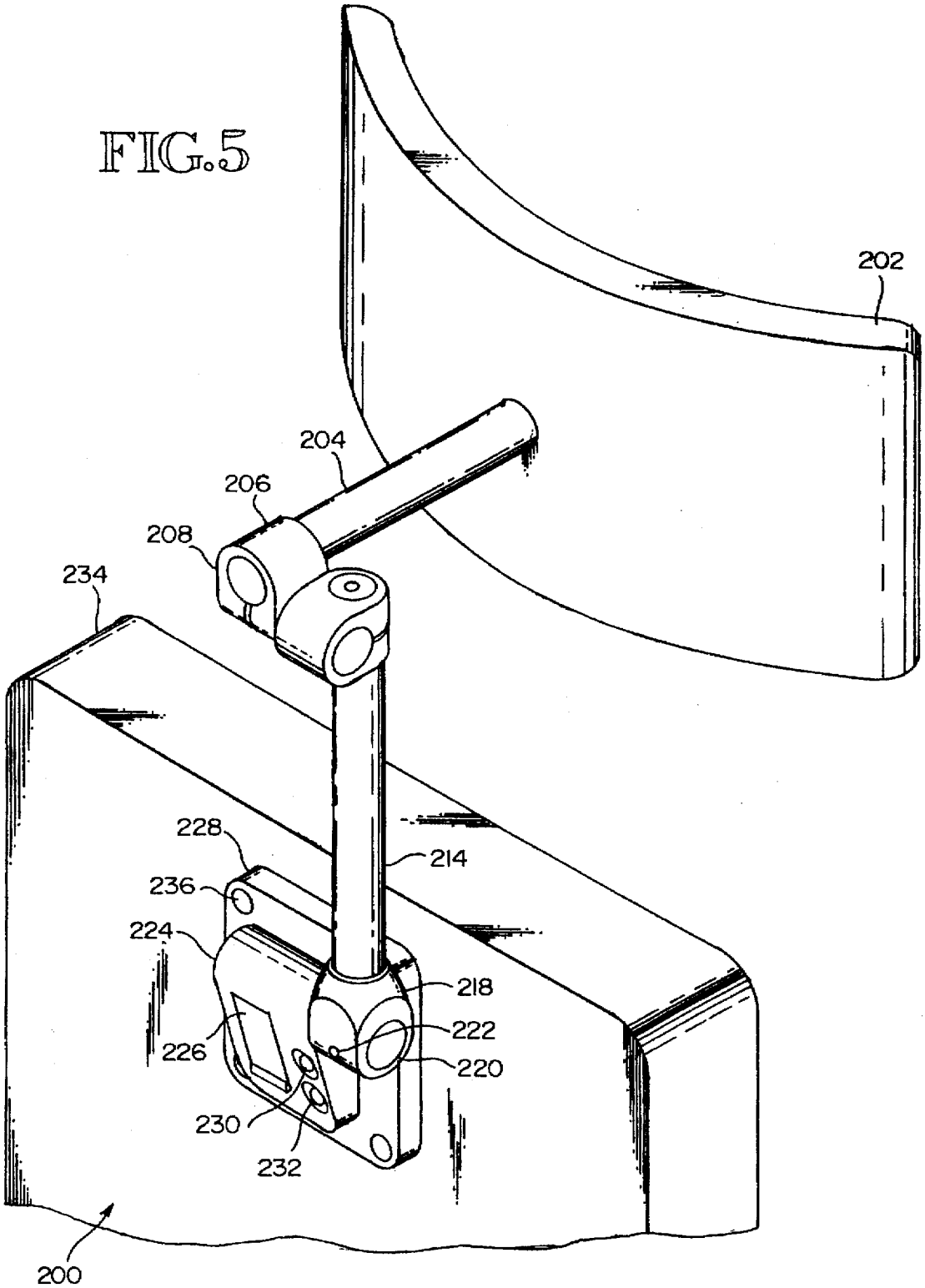
FIG. 5 is a perspective view of a third embodiment of the present invention.

A third embodiment of this invention is illustrated in FIG. 5 and generally designated by the number 200.

Referring to FIG. 5 it can be seen that support pad 202 is mounted to support rod 204 which in turn is rotatably mounted in double clamp assembly 206. The clamp assembly includes two clamps 208 and 210, each of which is identical to clamp 160 of FIG. 4. The clamps are joined by rod 212 which is similar to rod 166 in that Figure. One end (not shown) of rod 212, which is similar in shape to end 168 of rod 16.6, and is held in clamp 208 by a screw (not shown). Support rod 214, which is held in clamp 210 by screw 216, extends downward to fitting 218 which, in turn, is secured to axle 220 by pin 222. Axle 220, housing 224 and toggle 226 are similar to axle 140, housing 130 and toggle 134, respectively. The housing is mounted to base 228 by screws 230 and 232, and the base is mounted to wheelchair back support 234 by four screws such as screw 236.

Thus it can be seen that the present invention provides for a swing away support bracket assembly which incorporates many novel features and obvious advantages over the prior art. Although only three embodiments of this invention have been illustrated and described, it is to be understood that obvious modifications can be made of it without departing from the true scope and spirit of the invention.

I claim:

1. A swing away support bracket comprising:

a housing;

an axle rotatably mounted in the housing for rotation with respect to the housing;

a toggle pivotally mounted on the housing for releasably locking the housing with respect to the axle, the toggle and axle including engaging means for preventing relative rotation therebetween;

at least one axle support bracket rotatably mounted on the axle for rotation with respect to the axle;

means for limiting the rotation of the axle support bracket within a predetermined operating range with respect to the axle; and, means for preventing rotation of the axle support bracket about the axle in both directions.

2. The swing away support bracket of claim 1 wherein the engaging means includes a recess in the axle and a protrusion on the toggle for releasably engaging the recess in the axle.

3. The swing away support bracket of claim 2 wherein the recess includes opposing tapered walls and the provision is correspondingly tapered in cross section.

4. The swing away support bracket of claim 1 further including means for urging the toggle into engagement with the axle.

5. The swing away support bracket of claim 4 wherein the means for urging is a spring.

6. The swing away support bracket of claim 1 further including a support pad mounted to the housing.

7. A swing away support pad assembly for use on a wheelchair comprising:

a housing;

an axle rotatably mounted in the housing for rotation with respect to the housing and having a recess therein, the recess having opposing tapered walls;

a toggle pivotally mounted on the housing for releasably locking the housing with respect to the axle, the toggle including a protrusion for releasably engaging the recess in the axle;

means for urging the protrusion into engagement with the recess;

at least one axle support bracket rotatably mounted on the axle for rotation with respect to the axle;

means for limiting the rotation of the axle support bracket within a predetermined operating range with respect to the axle;

means for preventing rotation of the axle support bracket about the axle in both directions, and a support pad mounted on the housing.

8. A swing away support bracket comprising;

a housing;

an axle rotatably mounted in the housing for rotation with respect to the housing, the axle having a bore in one end thereof;

a toggle pivotally mounted on the housing for releasably locking the housing with respect to the axle, the toggle including means for engaging the axle;

at least one axle support bracket rotatably mounted on the axle for rotation with respect to the axle;

means for limiting the rotation of the axle support bracket within a predetermined operating range with respect to the axle; and, means for locking the axle with respect to the axle support bracket, the locking means including an end cap rotatably mounted in the bore and means for forcing the end cap into frictional engagement with the axle.

9. A swing away support pad assembly for use on a wheelchair comprising:

a housing;

an axle rotatably mounted in the housing for rotation with respect to the housing;

a releasable toggle pivotally mounted on the housing;

locking means for preventing rotation of the housing about the axle in both directions, the locking means including a recess in the axle and a protrusion on the toggle for releasably engaging the recess in the axle;

means for continuously urging the protrusion into engagement with the recess; and a support pad adjustably mounted on the axle for rotation with respect to the axle.

10. The swing away support bracket of claim 9 further including means for adjustably mounting the support pad on the axle, the means for mounting including at least one support rod.

11. The swing away support bracket of claim 10 wherein the means for adjustably mounting further includes at least one clamp.

* * * * *